United States Patent [19]

Bong et al.

[11] Patent Number: 4,754,743

[45] Date of Patent: Jul. 5, 1988

[54] MIXTURE CONTROL SYSTEM FOR INTERNAL COMBUSTION ENGINES

[75] Inventors: Lau C. Bong; Fong C. Yan; Wan W. Shum, all of Hong Kong, Hong Kong

[73] Assignee: Elec & Eltek Energy Resources Technology Limited, British Virgin Isls.

[21] Appl. No.: 831,939

[22] Filed: Feb. 20, 1986

[30] Foreign Application Priority Data

Oct. 9, 1985 [GB] United Kingdom ..... 8524922

[51] Int. Cl.[4] ..... F02M 23/06; F02M 3/055

[52] U.S. Cl. ..... 123/585; 123/327; 261/41.5; 261/DIG. 19

[58] Field of Search ..... 123/585, 586, 587, 440, 123/438, 325, 327, 332, 333; 261/DIG. 19, 41.5

[56] References Cited

U.S. PATENT DOCUMENTS

| | | | |
|---|---|---|---|
| 2,155,670 | 4/1939 | Macbeth | 123/585 |
| 2,749,894 | 6/1956 | Sariti et al. | 123/325 |
| 2,824,725 | 2/1958 | Dietrich . | |
| 2,840,359 | 6/1958 | Cornelius . | |
| 2,939,444 | 6/1960 | Leibing . | |
| 2,957,463 | 10/1960 | Schnabel . | |
| 3,297,103 | 1/1967 | Walker . | |
| 3,590,792 | 7/1971 | Masaki et al. | 123/327 |
| 3,807,172 | 4/1974 | Masaki | 123/440 X |
| 3,823,699 | 7/1974 | Adair . | |
| 3,996,908 | 12/1976 | Brown, III et al. . | |
| 4,226,218 | 10/1980 | Lutz . | |
| 4,287,864 | 9/1981 | Takada et al. . | |
| 4,454,080 | 6/1984 | Azosta | 261/DIG. 19 X |

FOREIGN PATENT DOCUMENTS

| | | | |
|---|---|---|---|
| 436109 | 9/1939 | Belgium . | |
| 498984 | 2/1951 | Belgium . | |
| 00132842 | 8/1980 | European Pat. Off. . | |
| 391107 | 3/1924 | Fed. Rep. of Germany . | |
| 2526408 | 12/1976 | Fed. Rep. of Germany . | |
| 963903 | 7/1950 | France . | |
| 01813 | 5/1983 | PCT Int'l Appl. | 123/327 |
| 515416 | 12/1971 | Switzerland . | |
| 294358 | 7/1928 | United Kingdom . | |
| 551263 | 2/1943 | United Kingdom . | |
| 668065 | 3/1952 | United Kingdom . | |
| 685366 | 1/1953 | United Kingdom . | |
| 1099350 | 1/1968 | United Kingdom . | |
| 2089895 | 7/1984 | United Kingdom . | |

*Primary Examiner*—Tony M. Argenbright

*Attorney, Agent, or Firm*—Majestic, Gallagher, Parsons & Siebert

[57] ABSTRACT

A carburator for internal combustion engines has a main jet for delivering fuel to be entrained with air as it passes through the carburator to the inlet side of the engine. A throttle valve is disposed downstream of the main jet for controlling the flow of air and entrained fuel. An idling jet disposed downstream of the throttle valve is adapted to deliver fuel to the air stream at a rate sufficient to ensure that the engine continues running while the throttle valve is substantially closed. The idling jet is additionally adaptable to admit air to the stream of air-fuel mixture as it flows through the carburator at higher rates of air flow. Means are provided to switch the idling jet between fuel delivering and air delivering modes in response to engine speed. Thus, at lower engine speeds fuel is delivered through the idling jet and a slightly rich mixture passes to the engine. At higher speeds, air is admitted resulting in a weaker mixture than has been set by the main jet and the throttle valve.

5 Claims, 2 Drawing Sheets

MIXTURE CONTROL SYSTEM FOR INTERNAL COMBUSTION ENGINES

This invention relates to internal combustion engines and particularly to the control of the air-fuel mixture delivered thereto. As it is well known, control of the air-fuel mixture delivered to an internal combustion engine is beneficial not only in minimizing the amount of fuel burned, but also in reducing pollution of the atmosphere by the discharge of unburned or only partially burned fuel. The present invention has particular use in motor vehicles.

Many proposals have been made with the intention of reducing the consumption of fuel in internal combustion engines and predominantly, these are concerned with reducing or cutting off the supply of fuel under certain engine running conditions. While to some extent the present invention functions in a similar way, it additionally proposes the dilution of the fuel/air mixture delivered to the engine by the delivery of additional air thereto.

A carburator used in modern internal combustion engines normally includes two systems for creating and delivering a fuel/air mixture to the engine along a common duct. The first system is adapted to provide a sufficient mixture to maintain the engine running at minimal, or idling speed, but without the delivery of substantial power output. The second system comes into operation when power is demanded from the engine, and operates in addition to the first system. In the basic carburator design, the effect of operation of the first system while the second is functioning was regarded as negligible, and no need was seen for shutting down the first system when it was effectively dominated by the second. More recent attempts to economize fuel consumption have sought to shut down entirely the first system mentioned above and to some extent this has resulted in improved economy.

Both systems referred to above operate to entrain a liquid fuel in a stream of air as it is drawn into the engine. As the first system is designed to deliver a fixed quantity of mixture at low engine speed, when the demand on the engine increases, the amount of fuel drawn from this system varies considerably. Thus, while a total cut off of the system when the engine is under load has clear benefits, we have found the engine performance can be further enhanced if the first system is used as a means for directly diluting the air-fuel mixture by delivering auxiliary air to the mixture downstream of the second system.

In a carburator adapted according to the invention a throat defines a duct in which the fuel is entrained in the stream of air drawn therethrough into the engine. The fuel is delivered to the airstream through at least an idling jet and a main jet disposed respectively downstream and upstream of a valve for controlling the cross-sectional area of the duct. At idling speeds, the valve is closed and a fuel-air mixture is delivered to the duct through the idling jet alone. As the valve is opened to increase engine speed, fuel is delivered through the main jet and entrained in the now increased stream of air being drawn into the engine through the throat. At a specified engine speed, the delivery of fuel to the idling jet is cut off, and the fuel-air mixture drawn therefrom into the throat is replaced by air alone. However, the path of fuel to the idling jet remains opened. The flow of fuel is prevented by a stream of air through the jet itself. A passageway through the jet is coupled to a valve which is selectively openable to allow passage of atmospheric air thereinto. A switch mechanism for actuating the valve is operative in response to the speed of the engine being above or below a specified level. As the engine speed goes above this level, the valve opens and air flows preferentially into the duct. As the engine speed falls below this level, the valve closes and the jet continues to operate to deliver a fuel/air mixture as required for idling.

In preferred embodiments of the invention the passageway through the idling jet is designed to discharge air laterally from the jet into the chamber from which fuel or air is drawn into the duct. In these cases, the jet has a central bore and one or more openings therefrom in the chamber. An opening at least can face the path of fuel to the jet to maximize the blocking effect on the delivery of fuel, although at least one other opening or port is normally also used. We have found that there can also be benefit in the adoption of a distribution of openings around the jet at substantially uniform spacings, circumferential and/or axial. Such an arrangement is illustrated in a particular embodiment described below. Broadly, we have found that best results are achieved with arrangements where the air flow is balanced, particularly with regard to the delivery of fuel to the chamber from which fuel or air is drawn into the duct.

The specified engine speed at which the valve will open to allow ingress of air through the idling jet will normally be in the range of 500 to 1200 r.p.m. depending on the characteristics of the particular engine. A typical switch speed for a modern car engine will be 1000 to 1100 r.p.m., 1100 r.p.m. being preferred.

Generally, the ideal air/fuel ratio in the mixture delivered to an internal combustion engine is approximately 15:1 by weight. In practice though, this desired ratio will vary depending on operating conditions. For example, to obtain maximum power output a ratio of approximately 13.5:1 by weight is normally required, while for economical running ratios of up to 16:1 are regarded as being acceptable. The maximum power output is normally required at low engine speeds, and the present invention enables richer mixture ratios to be achieved at low engine speeds, while assuring leaner ratios as the engine speed increases. The air flow through the idling jet effectively creates an air curtain which blocks delivery of fuel to the jet while simultaneously delivering auxiliary air to the air/fuel mixture in the carburator throat.

In the preferred embodiment of the invention, the idling jet is provided with a passageway therethrough which discharges air at a location just upstream of a conical tip formed at the end of the jet. When the valve is opened, the negative pressure in the throat draws air around the tip to creat the air curtain described above. In some carburators, the duct feeding fuel to the idling jet is also the source for a slow running jet which is also operative at low engine speeds, such speeds being higher than the idling or tick-over speed. In certain circumstances, the air flow through the idling jet at higher engine speeds will prevent the delivery of fuel also to the slow running jet. When this occurs, both the slow running and idling jets thus cease delivery of fuel to the carburator throat, further weakening the air-fuel mixture therein. The pressure difference between atmosphere and the carburator throat will thus determine whether both the idling and slow running jets are operative, thus achieving a desired air/fuel ratio in the mixture delivered to the engine. For example, under heavy load with the main control valve fully opened, this pressure difference may be very small even at engine speeds above the specified value, allowing fuel to be drawn into the throat from one or both of the slow running and idling jets.

The invention can be incorporated in any carburator which includes an idling jet. As described below, twin-choke carburators can likewise be adapted.

An embodiment of the invention will now be described by way of examples and with reference to the accompanying drawings wherein.

Figure 1:
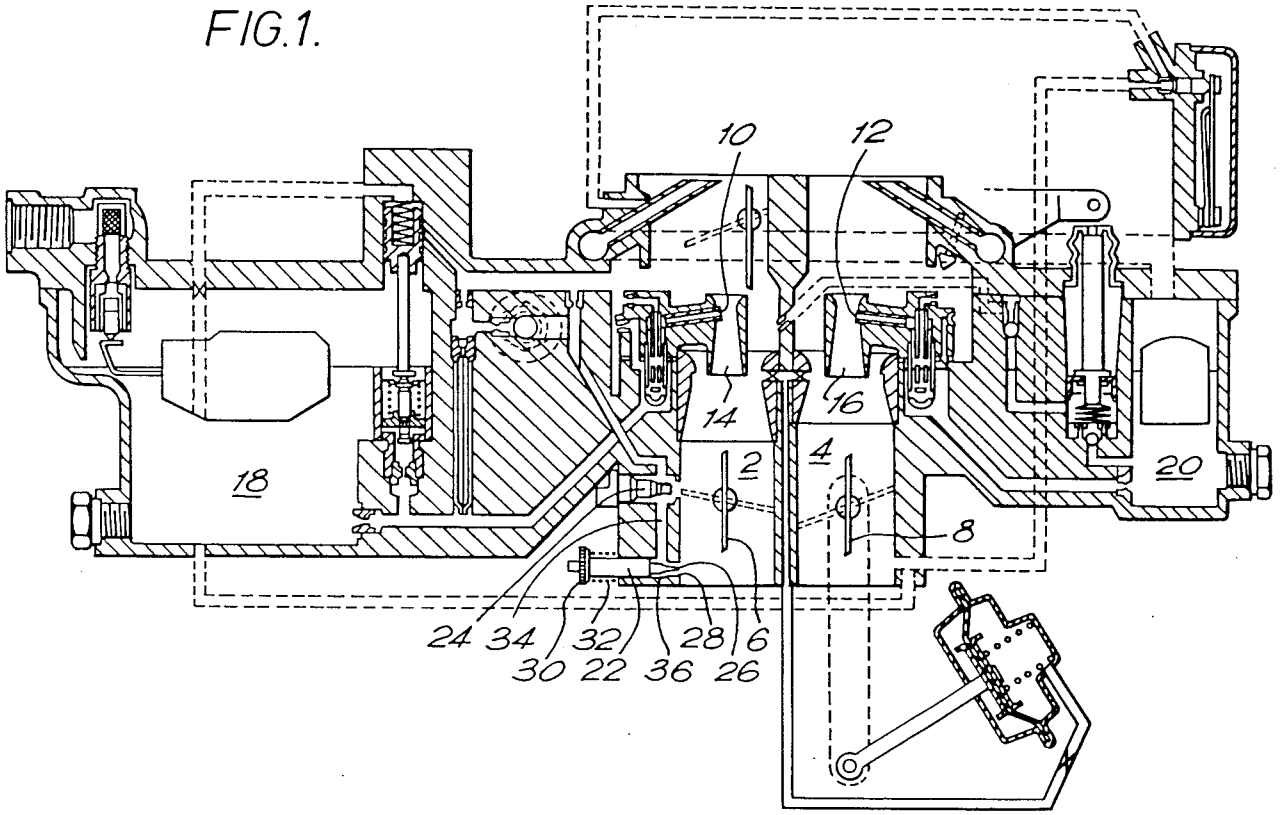
FIG. 1 shows schemetically in cross- section a a twin choke carburator generally of known design.

The carburator shown in FIG. 1 is of known twin choke design and has two inlet throats 2 and 4. The passage of the air-fuel mixture through the throat is controlled by butterfly valves 6 and 8 respectively. Value 6 is adapted to be coupled directly to the throttle control of the engine on which the carburator is mounted. Value 8 is controlled in response to load demand on the engine as determined by the balance of negative pressure in the throats 2 and 4. The fuel is entrained by air in passage through either throat 2, 4 from main jets 10 and 12 leading to venturis 14 and 16. Fuel is fed to the jets 10 and 12 fom float chambers 18 and 20.

The carburator includes two additional jets; an idling jet 22 and a slow running jet 24. The idling jet is operative at all times, and permits the passage of sufficient fuel into the throat downstream of the valves 6 and 8 to maintain the engine running at idling speed, even when both valves 6 and 8 are closed. When the valve 6 is opened, the slow running jet becomes operative, and allows fuel to enter the throat 2 as the pressure in the throat 2 drops in response to increase engine speed. As the valve 8 is further opened, the primary main jet 10 becomes operative. When the engine demand is high, for example under hard acceleration, the valve 10 opens to deliver additional fuel/air mixture to the engine through throat 4.

The construction and operation of the carburator shown in FIG. 1 is itself known, and further details will not be described. The present invention is concerned primarily with the function of the idling jet 22.

In the known carburator construction, the idling jet 22 comprises a needle having a conical tip 26 extending into and possibly through an opening 28 in the wall of throat 2. The jet is threaded, and the axial position in relation to the duct wall is adjustable by screwing the jet into or out of the wall. A knurled end 30 is provided on the jet for this purpose, and/or the jet may be rotatable by means of a screwdriver or spanner. To ensure that the jet remains in place once adjusted, a spring 32 is compressed between the duct wall and the knurled end 30.

Fuel is fed to the idling jet 22 along a passage 34 formed in the duct wall. The outlet from passage 34 is at or adjacent the conical tip 26 where a chamber 36 surrounds the jet. Fuel is drawn from the chamber through the opening 28 by the negative pressure generated by the passage of air through the throat 2. Axial adjustment of the jet alters the size of the passageway through the opening 28 by varying the spacing between the wall of the opening and the conical surface of the tip 26.

Figure 2:
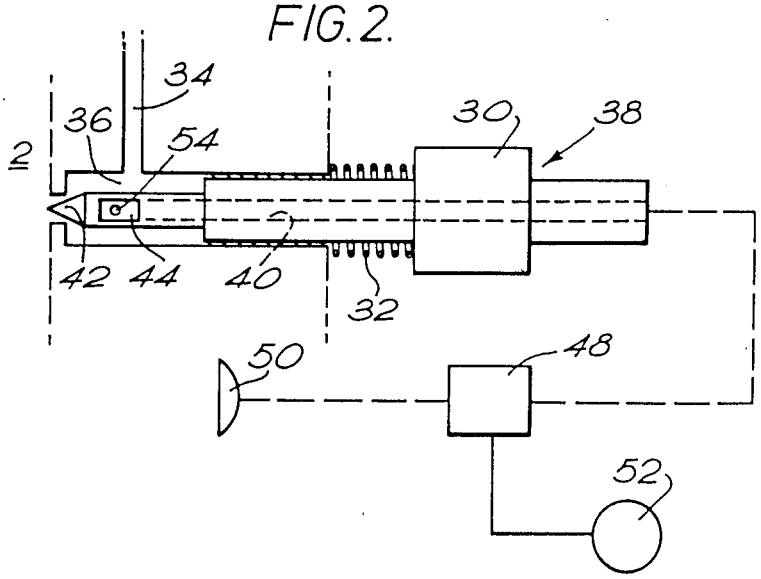
FIG. 2 is an enlarged elevation of an idling jet embodying the invention.

In accordance with the described embodiment of the invention, the idling jet 22 in FIG. 1 is replaced by the jet 38 shown in FIG. 2. The jet 38 is of substantially the same external shape as jet 22, but has an axial passageway 40 formed therein. The passageway 40 is adapted to deliver air in place of fuel to the throat 2. Thus, adjacent its conical tip 42, the passageway 40 terminates in a discharge opening 44. It will be noted that when installed in a carburator, this opening 44 will be within the chamber 36, and will preferably directly face the passage 34. Additionally an auxiliary discharge port 54 can be provided opposite the opening 44.

Figure 3:
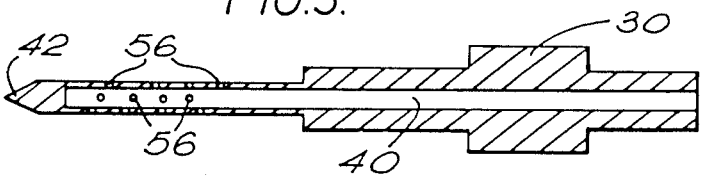
FIG. 3 is an enlarged axial cross-section through an alternative idling jet embodying the invention.

FIG. 3 shows an alternative idling jet embodying the invention. In this case, air can discharge from the passageway 40 through ports 56 axially and circumferentially spaced along and around the jet as shown. It will be appreciated that the manner in which discharge openings or ports are formed in the jet can take many forms, and be adapted for a particular carburator. It is though, always desirable to arrange for at least some discharged air to be directed towards the outlet from the passage 34 to have maximum direct influence on the flow of fuel therealong and, as discussed below on the flow of fuel to a slow running jet if included.

The other end 46 of the passageway 40 is coupled to a valve 48 which is selectively openable to allow passage of atmospheric air from a filter 50 into the idling jet 38. The valve 48 is in turn operated by a switch mechanism 52 which is responsive to engine speed. When the engine speed increases beyond a specified value, the switch 52 opens the valve 48, allowing air to pass through passageway 40 and then, by virtue of the negative pressure in the carburator throat, the air is drawn into the throat in preference to fuel from passage 34. The passage of air around the tip 42 of the jet 38 will form an air curtain which, at sufficient air flow, will block delivery of fuel from the passage 34. Under certain circumstances, air may also be forced up passage 34, and upstream of the slow running jet 24. In these circumstances, the fuel flow to the slow running jet also will be prevented. When this condition is reached, the air-fuel mixture ratio in throat 2 will be determined by the flow of air past the main jet 10 and the additional air that is delivered through idling jet 38, and possibly also the slow running jet 24. At high engine speeds, this will be a maximum ratio available, thus minimizing fuel consumption and air pollution by the discharge of unburned or partially burned fuel.

The valve 48 will normally be a solenoid operated valve linked to the switch 52. The switch can be easily coupled to the engine speed by an electrical connection to for example, the tachometer, dynamo, or alternator of the engine. Such electrical connections are well-known and can be readily adapted for use in the invention. The valve 48, filter 50 and necessary electrical circuitry can be mounted without difficulty on an existing engine already fitted to a vehicle or other apparatus. Thus, in combination with the adapted jet 38 a system embodying the invention can be manufactured as an accessory for fitment to working apparatus.

In a carburator adapted according to the invention, no loss of available power will be experienced as the operation of the modified idling jet 38 will also be dependent upon the pressure difference between the throat 2 and the atmosphere. If the engine demand is high and the pressure in the throat 2 increases, proportionally less air will be drawn through idling jet 38, and the air-fuel mixture will be enriched. Additionally of course, the air-fuel mixture delivered through throat 4 as a consequence of valve 8 being opened is unaffected by the delivery of auxiliary air through the idling jet 38.

By creating a leaner air/fuel mixture only at high engine speeds, substantially unaltered engine performance can be achieved at lower speeds. However, neither is performance diminished at higher engine speeds, as the system described is to a large extent self-adjusting. Substantial fuel savings can be made, of the order of 5% depending on the type of engine and the use to which it is put, and a wear on engine parts can also be reduced by the lowering of carbon deposition. Carbon emissions, particularly emissions of carbon monoxide, will also be reduced.

On most carburator engines, the idling jet on the carburator used is readily accessible for tuning purposes. The present invention can therefore readily be exploited in existing engines and carburators by the replacement of the existing idling jet with the idling jet valve and switch mechanism described herein. A slow running jet is not normally so readily accessible, but it will be appreciated that a slow running jet adapted according to the invention may also be included in a carburator as either an alternative or an addition to the idling jet described. It follows of course, that the system disclosed herein could readily be made part of a carburator at the manufacturing stage.

I claim:

1. A carburator having a housing defining a duct for the passage of air to the inlet side of an engine, a main jet for delivering fuel to the duct for entrainment by a stream of air passing through the duct; a throttle valve downstream of the main jet for controlling the flow of air and entrained fuel through the duct; an idling jet for delivering fuel for entrainment by said stream at low rates of air flow, which idling jet comprises an elongate body having a conical tip, the body traversing a chamber defined in the housing for receiving fuel and the tip extending into an opening in the duct wall downstream of the throttle valve of cross-section less than that of the body, the gap between the conical wall of the tip and the boundary of the opening defining a path for fuel to the duct, and is formed with a passageway therethrough terminating in an opening in the surface of the elongate body and in said chamber, the passageway being coupled via an air valve to a source of air, and the air valve being operable in response to signals from a speed sensor for monitoring the speed of a said engine to open whenever said sensed engine speed exceeds a predetermined value, regardless of throttle position, and close when said sensed speed falls below said predetermined value, whereby the idling jet is adaptable to admit air continulously to the duct in preference to fuel at higher rates of air flow corresponding to sensed speeds in excess of said predetermined level, with said passageway configured for directing said admitted air in a direction which opposes the flow of fuel to the duct and in an amount which increases with said higher rates of air flow, wherein the idling jet is configured to form an air curtain around the idling jet at first high rates of air flow for inhibiting fuel from being delivered by the idling jet, said carburator further including a slow running jet for admitting fuel to the duct between the main jet and the idling jet, where said idling jet is configured to form said air curtain around both the idling jet and the slow running jet at second high rates of air flow which are higher than said first high rates, for inhibiting fuel from being delivered by the slow running jet.

2. A carburator according to claim 1 wherein the passageway through the idling jet terminates in a plurality of openings in the surface of the elongate body spaced along and around the axis of the body.

3. A carburator according to claim 1 wherein the throttle valve is a butterfly valve dispersed adjacent the slow running jet.

4. A carburator according to claim 1 wherein said predetermined value is between about 1000 and 1000 r.p.m.

5. A carburator according to claim 1 wherein said predetermined value is greater than the r.p.m. of said engine when idling.

* * * * *

UNITED STATES PATENT AND TRADEMARK OFFICE

CERTIFICATE OF CORRECTION

PATENT NO. : 4,754,743

DATED : July 5, 1988

INVENTOR(S) : Bong et al.

It is certified that error appears in the above-identified patent and that said Letters Patent is hereby corrected as shown below:

Col. 6:
line 13: "continulously" should be --continuously--;
line 34: "dispersed" should be --disposed--; and
line 37: "1000 and 1000" should be --1000 and 1100--.

Signed and Sealed this

Fourth Day of October, 1988

*Attest:*

*Attesting Officer*

DONALD J. QUIGG

*Commissioner of Patents and Trademarks*